United States Patent [19]

Calucci

[11] Patent Number: 4,807,331

[45] Date of Patent: Feb. 28, 1989

[54] DOOR LIFT-OFF HINGE

[75] Inventor: William M. Calucci, Troy, Mich.

[73] Assignee: Chrysler Motors Corporation, Highland Park, Mich.

[21] Appl. No.: 104,189

[22] Filed: Oct. 5, 1987

[51] Int. Cl.[4] ..... E05D 7/10

[52] U.S. Cl. ..... 16/262; 16/272; 16/308; 16/382

[58] Field of Search ..... 16/272, 271, 262, 263, 16/382, 332, 308, DIG. 43

[56] References Cited

U.S. PATENT DOCUMENTS

| | | | |
|---|---|---|---|
| 1,092,236 | 4/1914 | Wrikeman | 16/271 |
| 3,488,793 | 1/1970 | Turpen | 16/263 |
| 3,729,772 | 5/1973 | Marchione | 16/334 |
| 4,482,023 | 11/1984 | Dziedzic et al. | 16/262 |
| 4,720,895 | 1/1988 | Peebles | 16/332 |

FOREIGN PATENT DOCUMENTS

| | | | |
|---|---|---|---|
| 2039592 | 8/1980 | United Kingdom | 16/308 |

*Primary Examiner*—Richard K. Seidel
*Attorney, Agent, or Firm*—Edward P. Barthel

[57] ABSTRACT

A door hinge assembly enabling a vehicle door to be readily removed and remounted during an assembly line operation, for example. A hinge body-half sub-assembly comprises a main member mounted on a body strut and a U-shaped link member, having a plurality of external guide surfaces, pivotally connected by a pintle pin to the main member. The door-half member is channel-shaped having its bight wall formed with a pair of normally extending sidewalls with one sidewall and the bight wall defining a pair of interior guide surfaces. Upon the door-half member being initially moved laterally into nested relation with the link member its interior guide surfaces are located in flush abutment with associated link member guide surfaces. Subsequent guided vertical sliding travel of the door-half member relative to the link member provides self-aligned reception of the pintle pin within a leaf flange pintle pin hole of the door-half member. Stop means on the pin completes the vertical travel wherein the door-half and link members providing interior and exterior flush abutting locking surfaces respectively, such that the members are in interlocked engagement for conjoint pivotal movement relative to the main member.

3 Claims, 5 Drawing Sheets

FIG.2
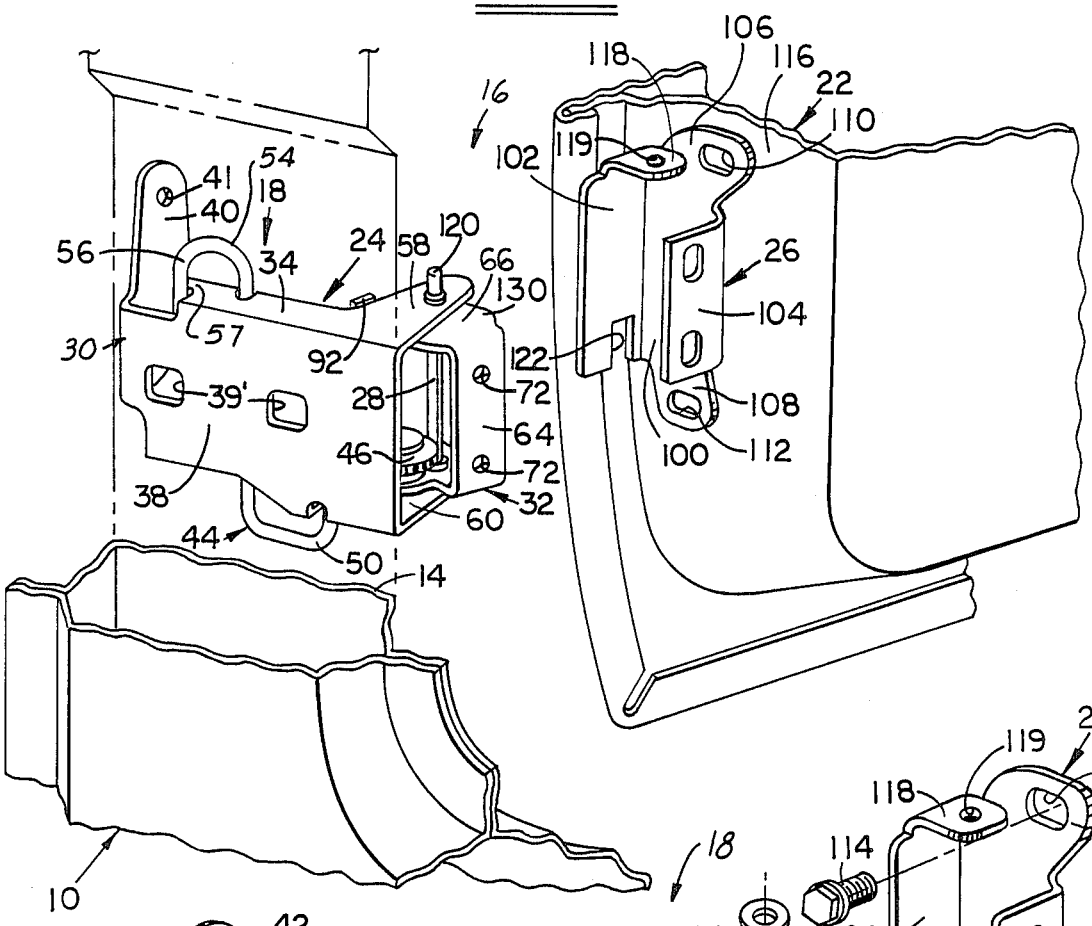
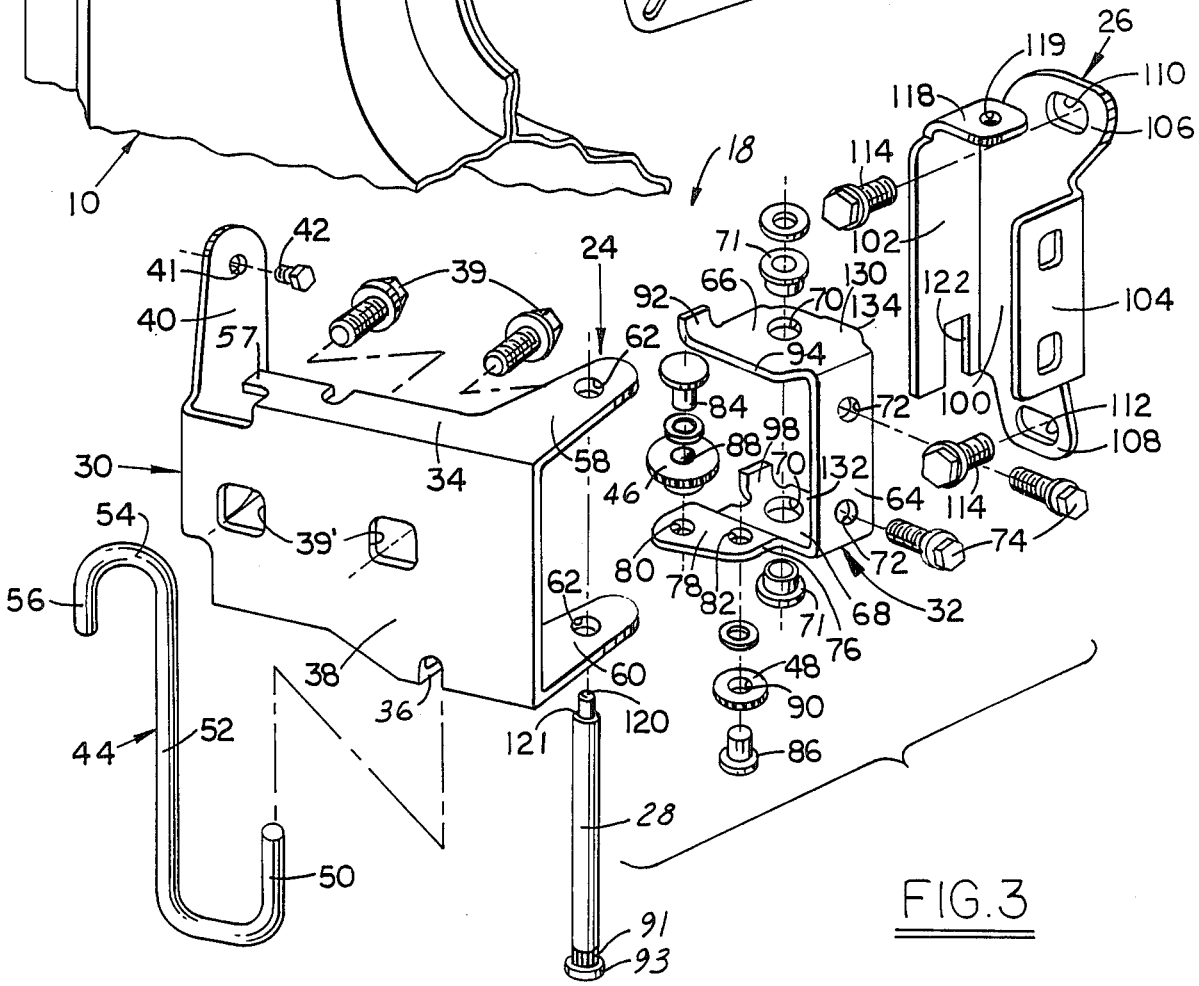
FIG.3

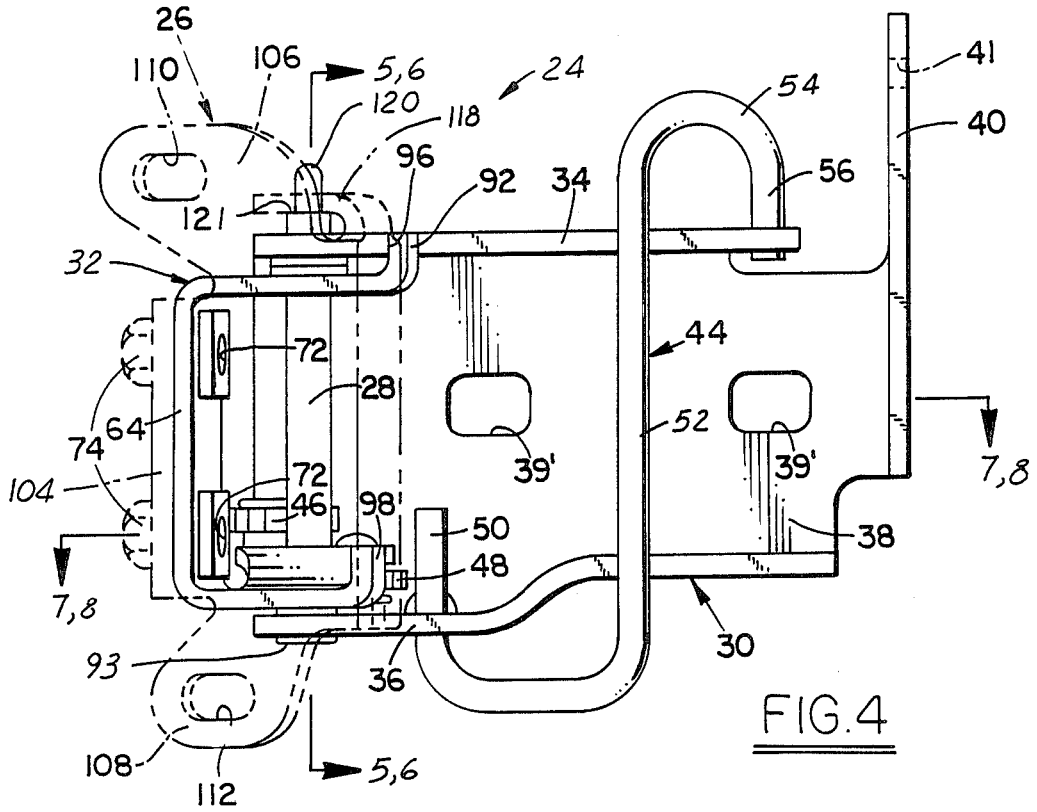
FIG.4
FIG.5
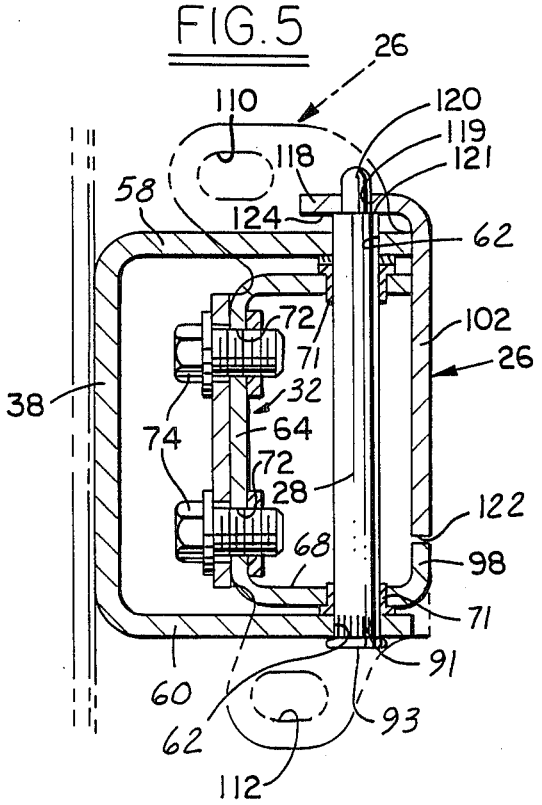
FIG.6
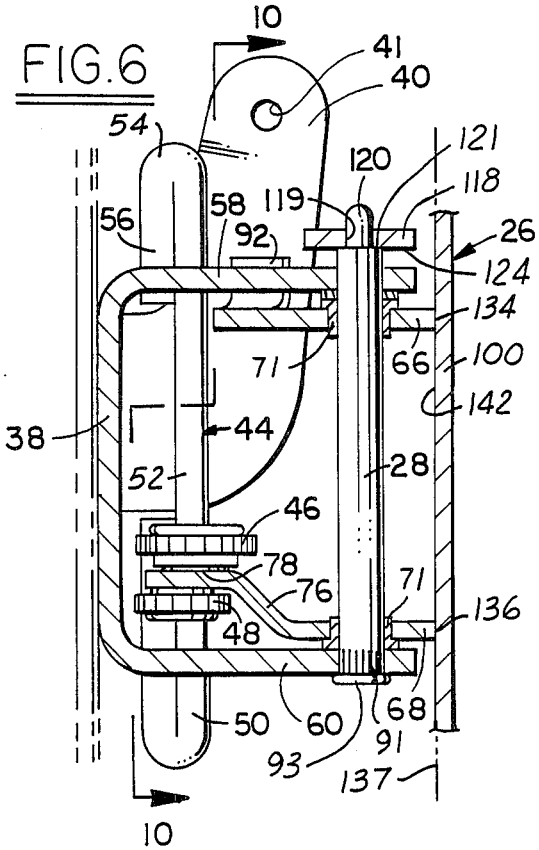

DOOR LIFT-OFF HINGE

BACKGROUND OF THE INVENTION

This invention relates generally to automobile door hinges and, more particularly, to a door lift-off hinge assembly suitable for mounting a vehicle door that can be temporarily removed and remounted in a ready manner.

The U.S. patent application Ser. No. 06/918,219; now U.S. Pat. No. 4,720,895 issued Jan. 26, 1988 to Peebles; entitled Quick-Disconnect Hinge, filed Oct. 10, 1986 and assigned to the same assignee as the instant application. The Peebles invention relates to an improved door hinge that enables vehicle doors to be quickly removed and rehung during the assembly line advancement of the vehicle body. Such a procedure allows the interior of the removed doors to be more conveniently equipped and trimmed while supported on a suitable assembly fixture. The U.S. Pat. No. 4,685,208 issued on Aug. 11, 1987 to Sekiraku discloses an apparatus for assembling vehicles which is operative to detach doors from vehicle bodies during assembly line travel and then to reattach each of the doors to the corresponding body.

In the Peebles invention the hinge is formed of two readily separable members, i.e., a body-half main member and a body-half U-shaped extension member. The body-half main member includes a channel shaped flat mounting plate portion engaging the vehicle body door opening pillar with its one end bent outwardly to define an angled portion. The extension member has a planar base portion formed with a pair of extended side flanges in the form of parallel outstanding legs each terminating in a hinge knuckle. The main member angled portion is sized for snug nested reception of the U-shaped extension. The extension base portion has an aperture that is readily aligned with an aperture on the angled portion bight wall. Upon tightening a single threaded bolt in the aligned apertures the members juxtaposed surfaces are shaped for mutual clamped abutment preventing separation or relative rotation of the members about the axis of the bolt. By virtue of holding the door upper and lower hinge pintle pins in proper relation to each other the precise original door mounting location is maintained upon remounting the door.

The U.S. Pat. No. 4,619,016 issued Oct. 28, 1986 to Brockhaus discloses a hinge attachment arrangement for an adjustable, detachable attachment of motor vehicle doors. The Brockhaus patent includes a pair of hinge wings interconnected by a hinge pin with one hinge wing to be secured to a vehicle door and the other to a fastening element secured to the door frame on the vehicle. The other hinge wing if secured to the fastening element by at least one bolt. The other hinge wing and the fastening element also have at least one continuous borehole for receiving a plug or bolt when the other hinge wing is attached to the fastening element. The borehole and the plug or bolt form guide surfaces which slide one relative to the other so that the guide surfaces afford self-centering and the elimination of play in the assembly of the hinge attachment arrangement.

SUMMARY OF THE INVENTION

It is an object of the present invention to provide a door hinge assembly enabling a vehicle door-half hinge member to be readily removed in a lift-off manner and remounted on a vehicle body-half hinge sub-assembly without further adjustments such as, for example, during assembly line advancement of the vehicle body.

It is another object of the invention to provide a lift-off hinge assembly as set forth above including a body-half pinned sub-assembly, comprising a main member fixed to a vehicle body and a link member pinned by a pintle pin thereto, and a door-half member readily mountable and separable on the link member. Upon the door-half member being moved laterally to a predetermined position a plurality of guide surfaces on the door-half member are brought into flush nested contact with a plurality of corresponding guide surfaces on the body-half link member such that a pintle pin hole on the door-half member has its center self aligned on the hinge pintle pin axis. The associated guide surfaces are operative, upon subsequent lowering of the door-half member, to position the hinge pintle pin in the body-half pin hole such that the door-half and link members are in predetermined interlocked engagement for conjoint swinging movement relative to the main member.

It is still another feature of the present invention to provide an improved torsion bar hold-open hinge assembly that allows a vehicle door to be readily removed in a lift-off operation and reattached in a self aligning manner by suitable means such as, for example, by a robot operated by instructions from a controller.

The body-half sub-assembly comprises a main member adapted for mounting to a vehicle body and a U-shaped link member hinged to the main member by a hinge pintle pin. The U-shaped link member is formed with a planar bight wall joining upper and lower legs having aligned holes pivotally connected by the pintle pin to aligned holes in the main member upper and lower flange extensions.

The hinge door-half member is generally channel-shaped defining a bight wall and first and second normally extending sidewalls. The first sidewall upper end has an inwardly extending leaf flange formed with a pintle pin hole. The door-half member provides a second sidewall interior surface together with a bight wall interior surface define a pair of right angle disposed alignment or guide surfaces. Upon each door-half hinge member being moved laterally its first interior guide surface is adapted to abut the exterior guide surface of the link member bight wall. This lateral movement is completed when a pair of upper and lower exterior guide edge surfaces, formed on the link member upper and lower legs respectively, abut the bight wall interior surface of the door-half hinge member wherein the door-half member leaf flange pintle pin hole center is vertically self aligned on the axis of the pintle pin.

Thus, upon the upper and lower door-half hinge members being lowered together with the door each upper and lower door-half hinge member is pivotally connected by means of an upper reduced portion on each pintle pin being received in its associated leaf flange pintle pin hole. The reduced pin portion defines a stop shoulder on each pintle pin adapted to contact the inner surface of its associated leaf flange. Thus, the pintle pin stop shoulder vertically positions each door-half hinge member in interlocked relation with its associated link member such that the vehicle door is remounted without further adjustments. Suitable fasteners, such as threaded bolts, are inserted in aligned holes in the abutting door-half hinge member second sidewall and the link member base wall thereby positively securing the interlocked members for conjoint pivotal movement relative to the body-half main member.

A feature of the hinge assembly involves a stop-lug extending upwardly from the link member upper leg. The stop lug is arranged to contact the body-half main member upper extension thus orienting the link member and the main member at a predetermined maximum open lift-off position of the hinge assembly. In the lift-off position of the disclosed embodiment the vehicle door extends at a desired maximum opening angle of the order of seventy five degrees to the longitudinal axis of the vehicle body. With the door in its lift-off position it is only necessary to remove the bolts securing each door-half upper and lower hinge member with its associated link member rendering the door free for lift-off detachment from the vehicle body. Upon the upper and lower door-half hinge members being raised with the door a predetermined distance each upper and lower door-half hinge member is disconnected from its associated pintle pin. The vehicle door is thus free to be moved laterally from the vehicle body for processing as described, for example, in the mentioned Sekiraku patent. The door may be subsequently readily remounted on the vehicle body without adjustments in the manner set forth above.

DESCRIPTION OF THE DRAWINGS

These and other features, objects and advantages of the invention will become apparent upon consideration of the specification and appended claims in conjunction with the accompanying drawings in which:

FIG. 2 is a fragmentary, perspective view of the lower hinge arrangement of FIG. 1, the view being taken inside the vehicle on the passenger side;

FIG. 3 is an exploded perspective view of the lower hinge arrangement of FIG. 2;

FIG. 4 is an enlarged vertical elevational view of the body-half hinge assembly of FIG. 1 with the door-half hinge member shown in phantom;

FIG. 5 is a vertical sectional view taken on the line 5—5 of FIG. 4 with the hinge arrangement shown in its closed position;

FIG. 6 is a view similar to FIG. 5 with the hinge arrangement shown at its maximum opening angle providing a door lift-off position;

DESCRIPTION OF THE PREFERRED EMBODIMENT

Figure 1:
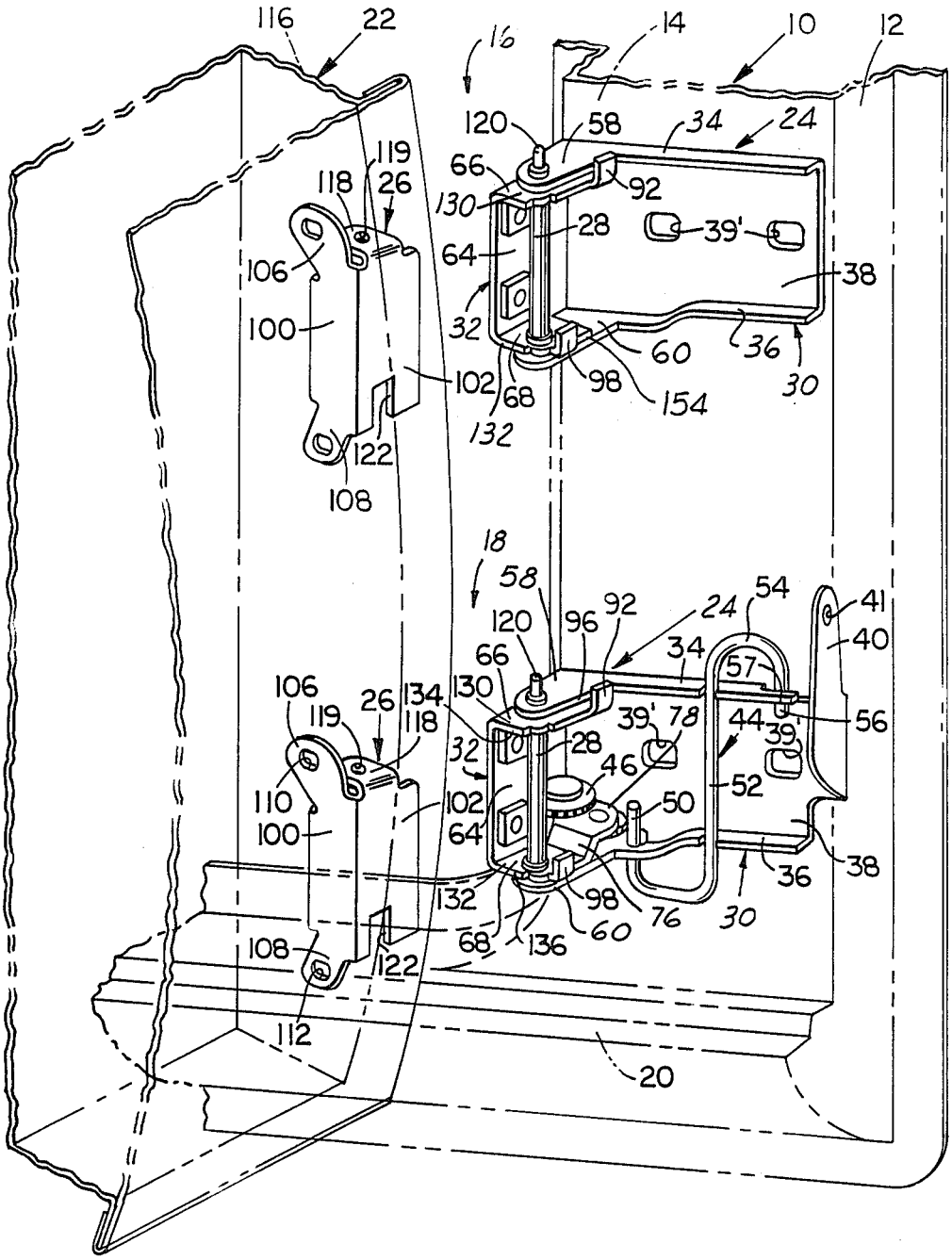
FIG. 1 is a fragmentary, perspective view of a vehicle body having passenger side door opening and a door adapted to be mounted for swinging movement by an upper and lower hinge arrangement.

Referring now to the drawings, there is shown in FIG. 1 a portion of a vehicle body hinge post or pillar 10 of a front right-hand side door opening defining a forward edge 12. The hinge post 10 has a longitudinally extending mounting surface 14 adapted to mount upper and lower lift-off door hinge assemblies generally indicated at 16 and 18, respectively. The door opening is defined in part by a bottom sill portion 20. A front right-hand door is shown at 22 adapted for hinged mounting on the hinge post 10 of the front door opening by the upper 16 and lower 18 hinge assemblies. The hinge assemblies are identical except that the lower hinge assembly 18 includes a torsion bar two position hold-open arrangement. Therefore, while only the bottom hinge assembly 18 will be described in detail it will be understood that the lift-off structure of the upper hinge assembly 16 is identical to the lower hinge assembly 18 as it relates to its lift-off structure and operation.

With reference to FIGS. 1 and 2, the lower lift-off hinge assembly 18 is illustrated comprising a body-half pinned sub-assembly 24 and a door-half hinge member 26 adapted to be pivotally interconnected through a pintle pin 28. The body half sub-assembly 24 includes a body-half main member 30 and a body-half link member 32.

FIG. 3 shows the main member 30 having a generally channel-shaped configuration in vertical section formed by a pair of upper and lower side flanges 34 and 36 interconnected by a vertically disposed planar mounting wall 38. Attachment of the mounting wall 38 to the vehicle body strut or post mounting surface 14 is preferably made by a pair of conventional machine bolts 39 extending through rectangular shaped apertures 39'.

Figure 8:
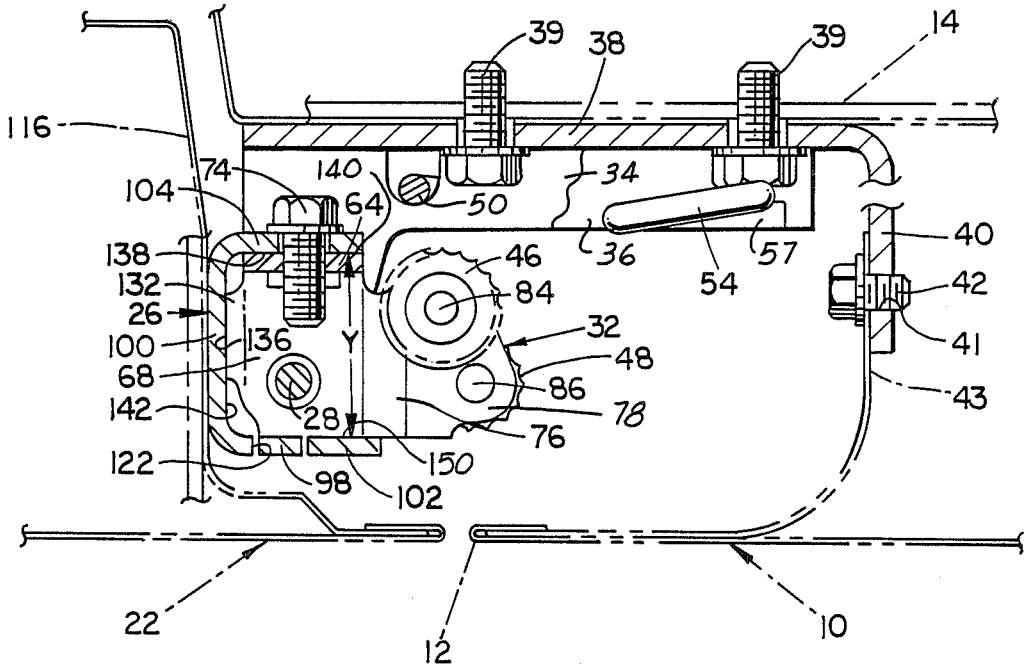
FIG. 8 is a horizontal sectional view taken on the line 8—8 of FIG. 4 showing the hinge arrangement in its closed position.
Figure 9:
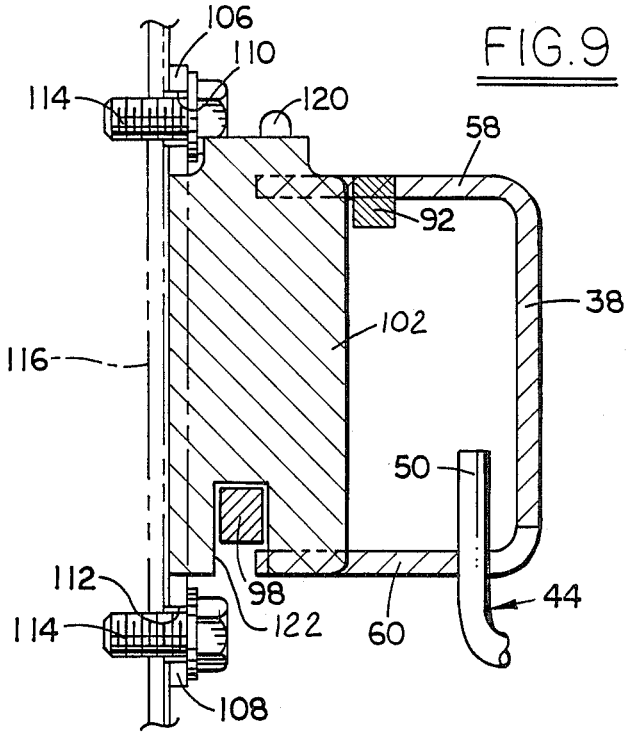
FIG. 9 is a fragmentary vertical sectional view taken on the line 9—9 of FIG. 7.

The main member 30 includes a projecting portion 40 formed at right angles to the plane of base wall 38. The projecting portion 40 has a hole 41 for the reception of threaded bolt 42 projecting through an aligned aperture in inner front fender wall 43 as seen in FIG. 8. A cam follower torsion bar spring 44 is mounted in preloaded condition on the hinge body half 30 for door hold-open purposes. The operation of the hold-open torsion bar spring 44, which forms no part of the present invention, is described in the above-mentioned U.S. Pat. No. 3,729,772 to Marchione, for example. The Marchione patent, the disclosure of which is incorporated by reference herein, may be referred to for a detailed description of a typical hold-open torsion bar hinge.

Cam means are provided in the form of two upper and lower spaced apart scalloped detent rollers 46 and 48, respectively, shown in FIG. 3. A deflectable torsion bar spring portion 50, parallel to main portion 53 of the torsion bar spring 44, is movable in the door opening and closing movements of the hinge assembly 18. Upon the roller 46 deflecting spring portion 50 the door is held releasably in its intermediate check or first hold open position. Deflection of the spring portion 50 by roller 48 places the door in its full open check or second hold open position. The torsion bar spring 44 has a lower radius arm 54 that is bent downwardly and has a free end 56 abutting a mounting wall portion 58 (FIG. 1).

Turning now to FIGS. 3–6, the hinge body-half sub-assemble main member 30 includes parallel upper and lower extensions 58 and 60, respectively, projecting outwardly from one end of their associated side walls 34 and 36. The extensions 58 and 60 have aligned holes 62 for the reception of the pintle pin 28.

The body-half sub-assembly link member 32 is generally U-shaped, as seen in FIGS. 3, 4 and 5, and comprises a planar vertically disposed base wall 64 formed with right angled flanges in the form of parallel upper and lower legs 66 and 68, respectively. The legs 66 and 68 have aligned holes 70 for the reception therethrough of upper and lower journal bushings 71 for receiving the pintle pin 28. As seen in FIGS. 5 and 6, the link member 32 is sized for reception between the extensions 58 and 60. FIG. 3 shows the link member 32 base wall 64 formed with a pair of vertically spaced holes 72 adapted for the reception of machine bolts 74 therethrough.

As best seen in FIGS. 3 and 6 the U-shaped link member 32 lower leg 68 includes an intermediate transverse projecting oblique portion 76 terminating in an upwardly offset flange portion 78. The offset flange portion 78 is provided with a pair of holes 80 and 82 for receiving rivet pins 84 and 86, respectively. The pin 84 extends through center hole 88 of the upper roller 46 for pivotal mounting on the upper surface of flange portion 78. The pin 86 extends through center hole 90 of the lower roller 48 for pivotal mounting as the lower surface of the flange portion 78.

Figure 7:
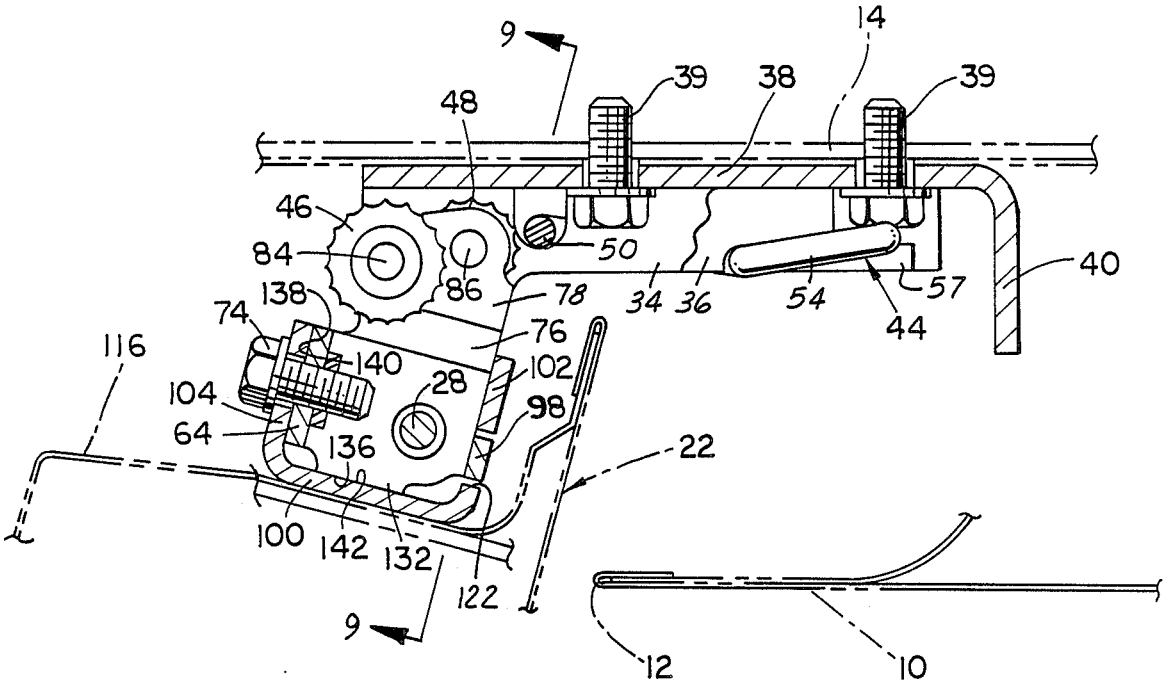
FIG. 7 is a horizontal sectional view taken on the line 7—7 of FIG. 4 showing the hinge arrangement in its maximum opening angle door lift-off position.

Upon the hinge link member 32 being pivotally mounted between the projections 58 and 60 it is free to pivot about pintle pin 28 between its door closed position shown in FIG. 8 and its door fully open position shown in FIGS. 1 and 7. It will be noted in FIG. 3 that the pintle pin 28 is provided with knurling 91 adjacent its head 93. The pintle pin 28 is driven in a tight fit in the hole 62 in the main member lower extension 60 such that the knurling 91 holds the pintle pin 28 against rotation relative to the extension 60. Consequently the link member 32, the door-half member 26, and the door 22 swing relative to the pintle pin 28 and the main member 30 on the body for movement of the door between open and closed positions.

As seen in FIG. 3 the U-shaped link member 32 upper leg 66 is formed with an upwardly extending stop tang portion 92 aligned with its one side edge 94. As seen in FIG. 4, the stop tang portion 92 is adapted to abut inclined edge 96 of the main member upper extension 58 with the hinge assembly in its maximum predetermined lift-off position of FIGS. 1 and 7. FIG. 3 also shows the free edge of the link member lower leg 68 formed with an upwardly extending rectangular shaped lug portion 98 for a purpose to be explained.

The door-half hinge member 26 is shown in FIG. 3 having a channel-shape in horizontal section including a bight wall 100 and a pair of first 102 and second 104 sidewalls arranged substantially perpendicular to the bight wall portion 100. The bight wall 100 is formed with co-planar upper and lower lobe portions 106 and 108, respectively. The upper lobe portion 106 has an aperture 110 while the lower lobe 108 has an aperture 112. The apertures 110 and 112 are adapted to receive machine bolts 114 (FIG. 3) therethrough for fixedly mounting the bight wall 100 to door pillar transverse extending hinge mounting panel 116.

The channel shaped door-half hinge member first sidewall 102 upper end is formed with an inwardly extending right angled leaf flange 118 having a pintle hole 119 therein for receiving upper reduced end portion 120 of the pintle pin therethrough. It will be noted in FIGS. 3, 5, and 6 that the reduced end portion 120 defines a stop shoulder 121 adjacent the upper end of the pintle pin 28. The stop shoulder 121 operates to vertically locate the door-half hinge member 26 relative to the link member 32 in a precise manner by contacting underface 124 of the leaf flange 118.

The channel-shaped door-half member first sidewall lower edge is formed with an open-ended rectangular slot 122 sized for snug reception of the lug portion 98 therein. The lug portion 98 provides additional interengagement between the door-half hinge member 26 and the link member 32 to insure that both members are additionally interfitted providing a rigid conjoint unit when they are interlocked.

With reference to FIGS. 1, 3, 7, and 8 it will be seen that the link member upper and lower legs 66 and 68 are each formed with tongue portions 130 and 132, respectively. Each tongue portion 130 and 132 defines an upper 134 and lower 136 guide edge surface respectively, included in a first common vertically disposed plane indicated by dashed construction line 137 shown in FIGS. 6 and 11. It will be appreciated that the plane of the guide edge surfaces 134 and 136 is oriented at right angles to the plane defined by exterior surface 140 of the link member base wall 64.

Figure 10:
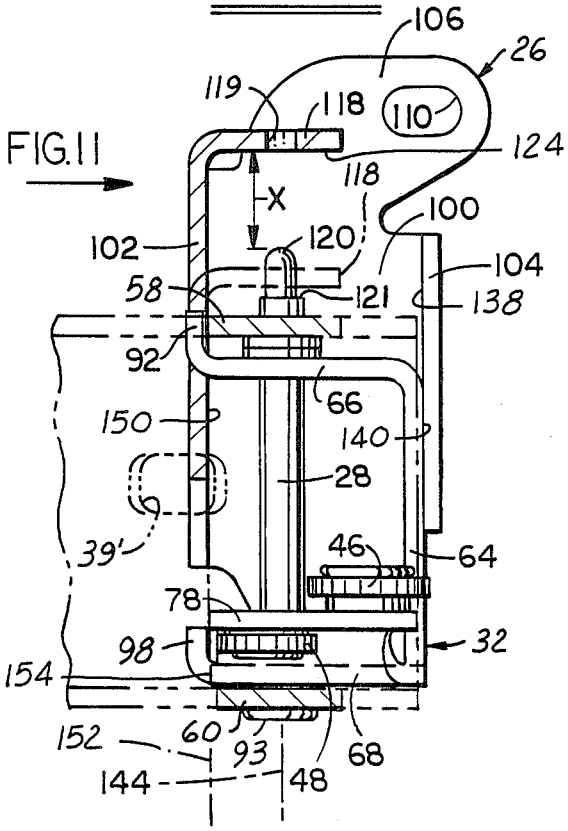
FIG. 10 is a vertical sectional view taken substantially on the line 10—10 of FIG. 6 showing the door-half hinge member moved initially into its nested self aligned position with the hinge body half member prior to be lowered to receive the pintle pin.
Figure 11:
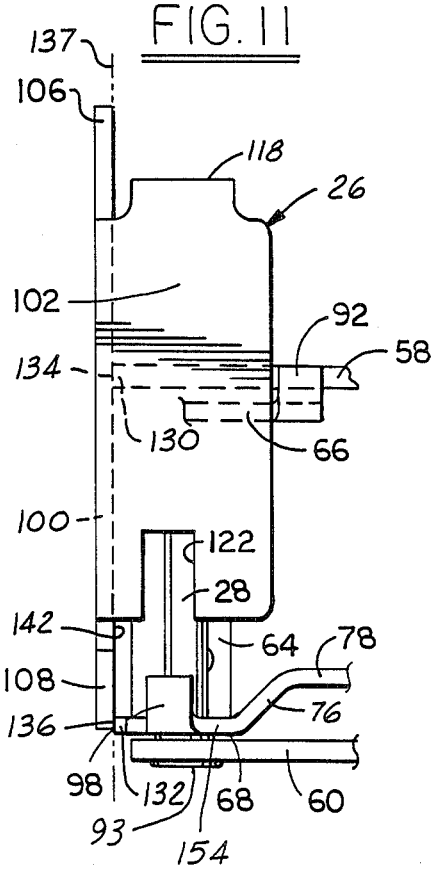
FIG. 11 is a fragmentary, side elevational view taken in the direction of the FIG. 11 arrow shown in FIG. 10.

In operation, upon the door-half hinge member 26 being initially moved laterally into nested relation with the link member 32 the door-half hinge member second sidewall interior surface 138 is positioned in flush abutment with link member base wall exterior surface 140. Also, the interior surface 142 of the door-half hinge member bight wall 100 contacts both the upper and lower exterior guide edge surfaces 134 and 136 of the link member. In it initial nested position it will be seen in FIGS. 10 and 11 that the door-half hinge member has its leaf flange inner surface 124 positioned a predetermined maximum distance "X" above the pintle pin reduced upper end portion 120. With reference to FIGS. 10 and 11 if the leaf flange 118 is positioned at a distance above reduced pin portion 120 greater than "X" the interior surface 142 of the bight wall lower lobe portion 108 will be elevated to a position where it is unable to contact or interface with lower exterior guide edge surface 136.

As seen in its FIG. 10 position the leaf flange pintle pin hole 119 is aligned with its center on the vertical pintle pin hinge axis shown at 144. Thus, upon the door-half member 26 being lowered relative to the link member 32 its movement is positively guided by the relative sliding movement between the flush surfaces 138, 140 and the relative sliding movement between of the bight wall interior surface 142 and the exterior guide edge surfaces 134 and 136. Upon the pintle pin upper portion 120 being received in the leaf flange pintle pin hole 119 and the leaf flange undersurface 124 seated on the pintle pin stop shoulder 122 the door-half hinge member 26 and the link member 32 are in fixed interlocked relation. This interlocked relation is enhanced because of the snug engagement of the lug portion 98 in the open ended slot 122.

In this regard it will be noted that the predetermined dimension "Y" shown in FIG. 8 is important to provide an interfitted relation of the members including the aligned snug engagement of the lug portion 98 in the slot 122. As seen in FIG. 10 the door-half member first sidewall 102 has its interior interlocking surface 150 included in a second vertically disposed plane defined by dashed construction line 152. It will be noted that the plane of interlocking surface 150 also includes edge interlocking surface 154 of the link member lower leg 68. Upon the door-half member 26 being lowered the vertical distance "X" to its FIG. 5 position its first wall interior interlocking surface 150 is placed in flush contact with the exterior edge interlocking surface 154. These abutting surfaces 150 and 152 together with the abutting guide surfaces establish an interfitted or interlocked relation between the link member 32 and the door-half member 26 without play therebetween enabling their conjoint swinging movement relative to the main member 30.

It is understood that the invention is not limited to the exact construction illustrated and described above but that various changes and modifications may be made without departing from the spirit and scope of the invention as defined in the following claims.

What is claimed is:

1. In a lift-off hinge assembly of the type having a body-half sub-assembly adapted to be secured to a vehicle body and a door-half member pivotally connected by a pintle pin about a vertical hinge axis to said body-half sub-assembly, said lift-off hinge assembly particularly adapted to enable removal and mounting of a vehicle door during manufacture of the vehicle, said lift-off hinge assembly comprising:

a hinge body-half assembly including a main member adapted to be secured to the vehicle body and a U-shaped link member pivotally connected by a pintle pin aligned on said hinge axis to said hinge main member;

said main member having upper and lower parallel extensions interconnected by a mounting wall, said mounting wall adapted to abut the vehicle body with said upper and lower extensions each having a pintle pin hole aligned on said hinge axis;

said U-shaped link member formed with a base wall having a planar exterior guide surface and upper and lower parallel legs projecting therefrom, said upper and lower legs having aligned pintle pin holes for the reception of said pintle pin;

each said upper and lower leg having a guide edge surface thereon, each said leg guide edge surface located in a vertically disposed plane oriented at right angles to a plane that includes said base wall exterior guide surface;

said link member having stop means thereon adapted to contact said main member so as to pivotally position said link member relative to said main member at a predetermined door lift-off position providing a maximum door opening angle;

said door-half member having a channel-shape including a bight wall and a pair of first and second parallel sidewalls extending normally from said bight wall, said first sidewall upper end being formed with an inwardly extending leaf flange having a pintle pin hole therein;

said door-half member of a size such that upon its initial lateral movement relative to said body-half sub-assembly said door-half member is in predetermined nested contact with said link member, wherein said door-half member second sidewall having its interior surface positioned in flush abutment with said link member base wall exterior surface and the interior surface of said door-half member bright wall contacting both said link member upper and lower guide edge surfaces, whereby said leaf flange is spaced a predetermined distance above said pintle pin upper end with said leaf flange pin hole center self aligned on said hinge pintle pin axis;

whereby upon said door-half member being lowered a predetermined vertical distance said pintle pin having its upper free end portion received in said leaf flange pin hole and said leaf flange having its inner face contacting stop means on said pintle pin; and whereby said door-half member first sidewall having its interior surface in flush abutment with an opposed side edge surface of said link member lower leg such that said door-half member and said link member are in predetermined interlocked engagement for conjoint swinging movement about said hinge axis relative to said main member.

2. The lift-off hinge assembly as set forth in claim 1, wherein said link member stop means is in the form of a stop tang bent upwardly from said link member upper leg such that upon said link member being pivoted to its maximum open angle lift-off position said stop tang connecting said main member, and whereby said door-half member is adapted to be raised vertically from said link member said predetermined vertical distance enabling said door-half member to be disconnected from said main member.

3. The lift-off hinge assembly as set forth in claim 1, wherein said pintle pin is formed with an upper reduced diameter end portion adapted to be pivotally received in said leaf flange pintle pin hole, and said pintle pin reduced upper end portion defining a stop shoulder, whereby said stop shoulder is adapted to contact the undersurface of said leaf flange thereby vertically locating said door-half member in a precise location relative to said link member by contacting said leaf flange undersurface.

* * * * *